US006109196A

United States Patent [19]

Silber

[11] Patent Number: 6,109,196

[45] Date of Patent: Aug. 29, 2000

[54] METHOD OF CLOSING A STUFFED TOY AFTER STUFFING

[75] Inventor: Dennis Silber, Ferndale, Mich.

[73] Assignee: Tonyco, Inc., Ferndale, Mich.

[21] Appl. No.: 09/410,523

[22] Filed: Oct. 1, 1999

Related U.S. Application Data

[60] Provisional application No. 60/102,650, Oct. 1, 1998.

[51] Int. Cl.[7] ..... D05B 97/00; A63H 3/02

[52] U.S. Cl. ..... 112/475.08; 53/452; 53/469; 446/369

[58] Field of Search ..... 112/475.08, 475.01, 112/475.04, 475.17; 446/369, 370, 372, 385; 29/91, 91.1; 53/452, 467, 469, 258, 558

[56] References Cited

U.S. PATENT DOCUMENTS

| | | | |
|---|---|---|---|
| 4,063,402 | 12/1977 | Washburn et al. | 53/258 |
| 5,096,760 | 3/1992 | Thary | 446/369 X |
| 5,182,844 | 2/1993 | Honda | 446/372 X |
| 5,182,845 | 2/1993 | Dean | 446/372 X |
| 5,199,244 | 4/1993 | Beier et al. | 53/469 X |
| 5,885,128 | 3/1999 | Blaustein et al. | 446/369 |
| 5,889,160 | 5/1999 | Hoag | 53/452 X |
| 5,989,095 | 11/1999 | Wotton | 446/385 |

*Primary Examiner*—Peter Nerbun

*Attorney, Agent, or Firm*—Gifford, Krass, Groh, Sprinkle, Anderson & Citkowski, P.C.

[57] ABSTRACT

A method of making a stuffed toy requires first fastening together multiple fabric pieces to make a container which encloses an interior volume and which has an exterior surface. The container includes an opening into the interior volume which has two lips. A length of filament is used to stitch through the fabric to form multiple spaced apart loops along the length of the opening. Each loop extends from one lip to the other and is untensioned so as to allow the lips to be separated. A stuffing apparatus with an injection tube can propel stuffing material through the tube. The tube is inserted into the opening between adjacent loops of the filament and stuffing material is injected into the interior volume of the container. The injection tube is then withdrawn and the filament is tensioned to tension the loops to draw the lips into abutment.

7 Claims, 2 Drawing Sheets

METHOD OF CLOSING A STUFFED TOY AFTER STUFFING

CROSS-REFERENCE TO RELATED APPLICATIONS

This application claims the benefit of U.S. Provisional Application having Serial No. 60/102,650 filed Oct. 1, 1998.

FIELD OF THE INVENTION

This invention relates generally to sewing and, more particularly, to a method of closing an opening in the skin or body of a stuffed toy after the toy is filled with stuffing material.

BACKGROUND OF THE INVENTION

Stuffed animals and toys are typically formed by filling a sewn fabric skin or body with a resilient material such as polyester-cellulose fibers alone or along with polystyrene beads or other filler materials, creating a three-dimensional soft and resilient representation of an animal or other toy. Most stuffed toys are manufactured by first sewing the skin together from multiple pieces of fabric, leaving an opening through which stuffing may later be inserted. Where two pieces of fabric are sewn together, they are sewn such that the bulky portion of the seam faces the inside of the finished skin. Therefore, the skin is sewn inside out so that unfinished edges of the pieces of fabric from which the skin is formed are all located on the inside of the finished stuffed toy. Once the pieces of fabric are all sewn together into a finished skin or body, the skin or body is turned right side out so that the best and smooth finished side of the fabric faces outwardly and the rough seams are hidden. Next, stuffing is inserted through the stuffing opening until the inside of the skin is substantially full of the stuffing material, giving the stuffed toy a resilient three-dimensional shape, much like the inflating of a balloon.

In small scale or custom manufacturing, the plush toy may be hand stuffed. That is, handfuls of stuffing may be pushed through the stuffing opening in the skin or body. In larger scale manufacturing, some type of stuffing injection tube is often used to insert stuffing into the skin or body. An injection tube is inserted through the stuffing opening and the stuffing material is then injected or pumped through the tube into the interior of the stuffed toy.

When the stuffed toy is sufficiently filled with stuffing material, the stuffing opening must be closed to give the stuffed toy an acceptable appearance and to prevent leakage of the stuffing material. Traditionally, the stuffing opening is sewn closed from the outside of the skin using a sewing machine. This approach has several disadvantages. First, the resulting seam generally has a wound-like appearance. That is, sewing the opening shut from the outside creates a ridge or thick-type scar which is readily apparent on the skin of the finished stuffed toy. It is desirable to eliminate this wound-like ridge or thick-type scar to improve the appearance and feel of stuffed toys. Secondly, closing the stuffing opening from the outside of the skin after the stuffing material is inserted can be a relatively time consuming procedure and a costly labor expense. Also, special equipment such as sewing materials and/or a sewing machine are required to close the opening. It is desirable to eliminate this sewing step, thereby eliminating the need for a sewing machine and/or sewing materials at the final stage of stuffed toy production. It is also desirable that the stuffing opening be closed in such a way that considerable time is saved compared to the traditional and costly sewing method.

SUMMARY OF THE INVENTION

The present invention overcomes many of the shortcomings of the prior art by providing an improved method for making a stuffed toy. First, a plurality of fabric members are fastened together to define a container which encloses an interior volume and which also has an exterior surface defining the shape of the toy. The container includes an opening which is in communication with the interior volume. The opening has a first and a second lip. A length of filament is provided and the filament is stitched through the fabric so as to form a plurality of spaced apart loops along the length of the opening. Each loop extends from the first lip to the second lip of the opening with the lips being untensioned so as to allow the lips to be separated. A stuffing apparatus is provided which has an injection tube and a means for propelling a stuffing material through the tube. The injection tube is inserted into the opening between adjacent loops of the filament and stuffing material is injected into the interior volume of the container through the tube. The tube is then withdrawn and the filament is tensioned to tension the loop to draw the lips into abutment. In this way, stuffing is retained in the interior volume.

DETAILED DESCRIPTION OF THE PREFERRED EMBODIMENTS

Figure 2:
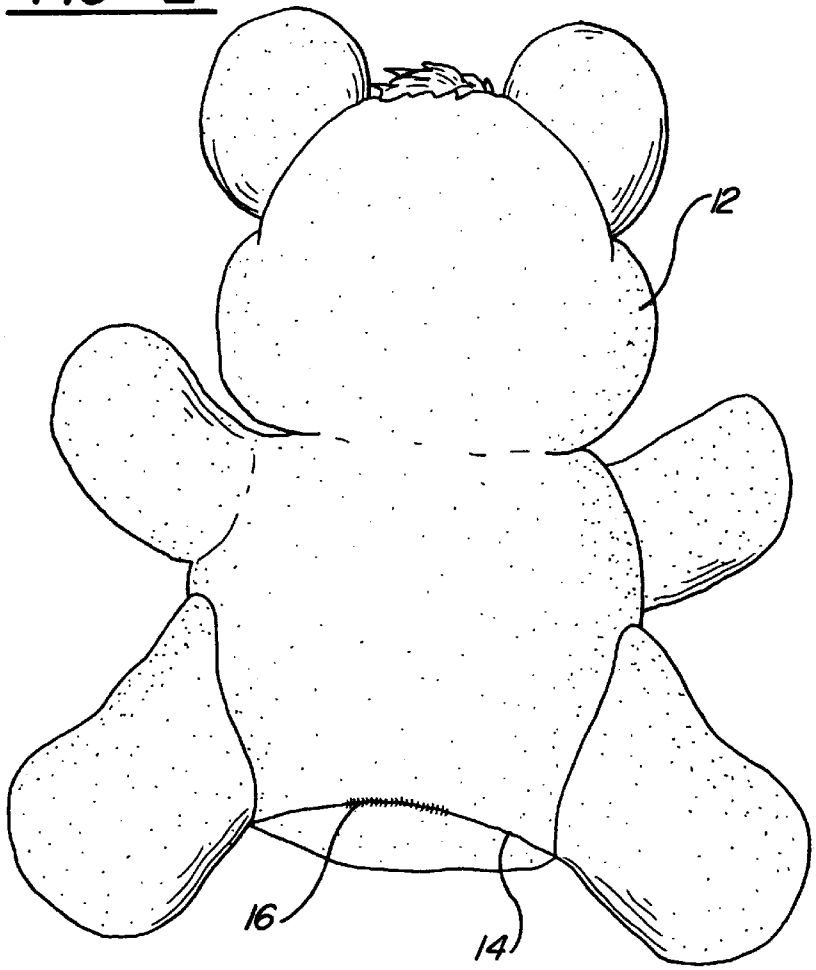
FIG. 2 is a rear elevational view of the stuffed toy of FIG. 1.
Figure 1:
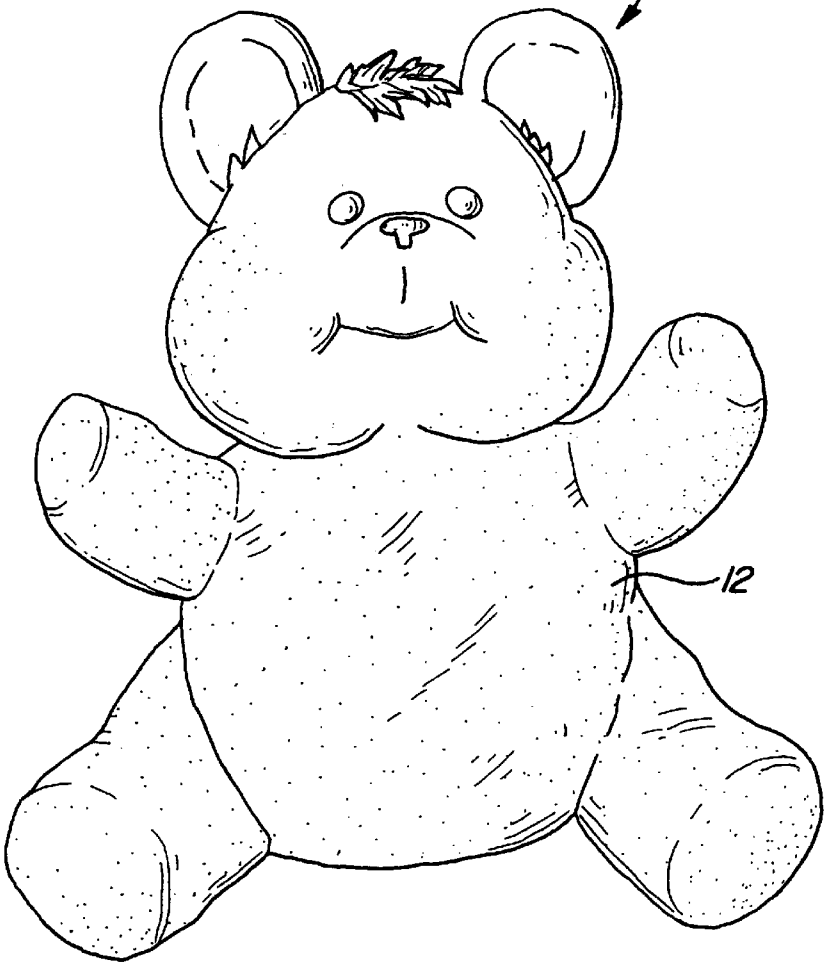
FIG. 1 is a front elevational view of a stuffed toy.

FIG. 1 shows one type of stuffed toy 10, a stuffed bear. The stuffed toy 10 is constructed by filling a sewn fabric skin or container 12 with a resilient stuffing material such as polyester-cellulose fibers and/or polystyrene beads or other filler materials. The skin or container 12 is typically assembled from multiple fabric members which are sewn together inside out so that the raw or thick-type scar edges of the fabric seams are on the inside of the skin. A stuffing opening is left for filling the skin. The skin 12 is then turned right side out and filled with stuffing material, and the stuffing opening is traditionally sewn shut. FIG. 2 shows a rear view of the stuffed toy 10 with a seam 14 near its bottom edge. In this example, a portion of the seam 14 had been left open to allow stuffing material to be inserted into the inside of the skin 12. In FIG. 2, the stuffing opening has been sewn closed leaving a wound-like raw edge or thick-type scar 16 on the seam 14. Some embodiments of the present invention seek to avoid this wound-like raw edge or thick-type scar appearance of seam 16.

For definitional purposes, the skin 12 of the toy 10 can be thought of as a container. The container encloses an interior volume and has an exterior surface which defines the shape of the toy. In the example shown, this exterior surface is a cosmetic fur covered surface. The stuffing opening communicates with the interior volume of the container, thereby allowing stuffing material to be inserted therein.

Figure 3:
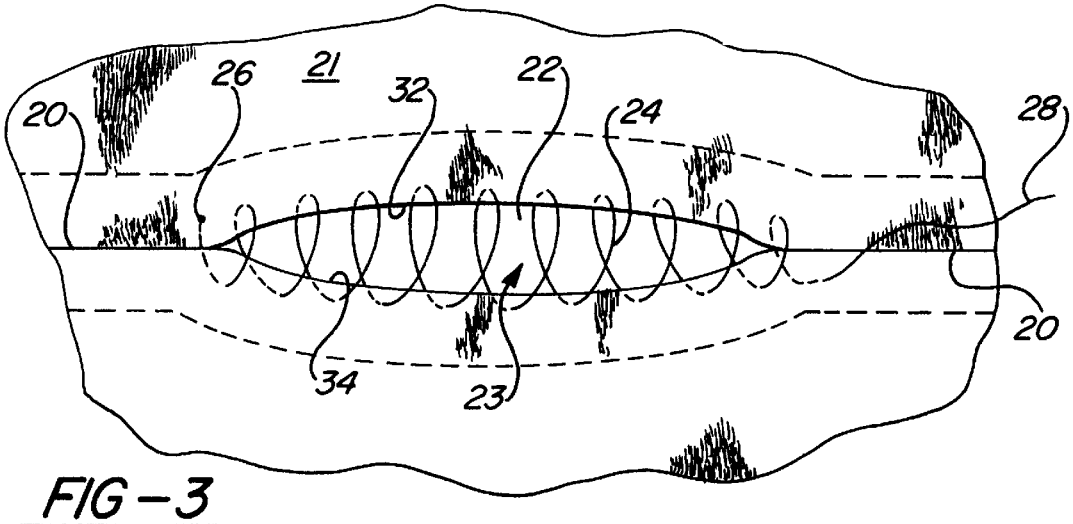
FIG. 3 is a close up view of a stuffing opening in the skin of a stuffed toy including an untensioned prestitched filament for closing the stuffing opening according to the method of the present invention.

Referring now to FIG. 3, a seam 20 in the skin of a stuffed toy is shown. The seam 20 has been sewn on the inside of the skin or body such that a stuffing opening 22 remains. The seam 20 would typically be formed using small, closely spaced stitches using fine but tough thread. The seam 20 is finished at each end of the opening 22 to prevent the seam 20 from unraveling. By finished, it is meant that the seam 20 is sewn in such a way that it does not unravel.

In FIG. 3, the skin or container of the stuffed toy is shown turned right side out. That is, the aesthetic exterior surface 21 is shown on the outside while the opening 22 communicates with the interior volume 23 of the container. The stuffing opening 22 is typically six to eight inches in length, but may be larger or smaller. Also, the stuffing opening is usually a part of a seam, but may be formed elsewhere.

In the method according to the present invention, a heavier filament 24 is loosely prestitched across the opening 22. The filament 24 is thicker and stronger than the thread typically used to sew the various fabric members together to form the skin or container. For example, the filament 24 may be heavy duty nylon thread or fish line with a high tensile strength. The filament 24 may be a single strand or may be formed from multiple strands, as will be clear to those of skill in the art.

The filament 24 preferably is secured at one of its ends 26 to the fabric adjacent the seam 20 near one end of the opening 22. This end 26 of the filament 24 may be secured to the fabric in any of several ways. For example, it may be sewn into the seam 20 or knotted and threaded through the fabric. The filament 24 is then stitched loosely across the opening 22 as shown in FIG. 3 much like a criss-cross shoelace on a shoe. For informational purposes, the opening 22 is defined as having a first lip 32 and a second lip 34 which define the upper and lower edges of the opening 22. In the figure, loose loops of the thread 24 pass through one lip 32 or 34 of the opening 22, across the opening 22, and through the other lip 32 or 34. These loops repeat at spaced apart intervals continuously across the opening 22 much like the lace of a shoe. Filament 24 is loosely sewn across the opening 22 from one end to the other so as to allow the insertion of a stuffing injection tube or other means of filling the skin. As shown, the loops are spaced apart much further than typical seam stitching. Typically, the loops are spaced apart between ⅛ and ½ of an inch. Secured end 26 of the filament 24 is shown at the left end of the opening 22 in FIG. 3 and is securely attached to the fabric. The other end 28 of the filament 24 extends out of the skin 12 and away from the exterior surface 21 at the right end of the opening 22.

Figure 4:
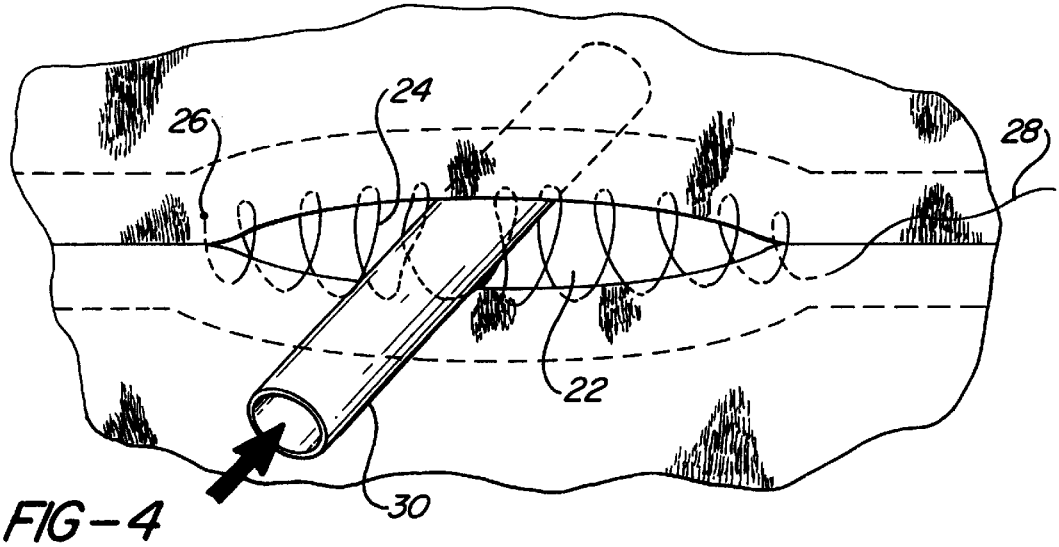
FIG. 4 is a close up view of the stuffing opening of FIG. 3 with a stuffing injection tube inserted between loops of the untensioned prestitched filament for filling the skin with stuffing material.

Referring now to FIG. 4, the stuffed toy is filled with stuffing material using an injection tube 30 which is inserted through the opening 22 from the outside of the skin or body to the inside. Though not shown, the injection tube 30 is part of a stuffing apparatus which also includes a device for propelling stuffing material through the injection tube. As is known to those of skill in the art, injection tubes come in various sizes but are typically in the range of one to four inches in diameter. Stuffing material is then injected or pumped through the tube 30 into the interior of the skin or body thereby filling the skin or body with stuffing material and giving it a three-dimensional shape. Once the skin or body is sufficiently filled with stuffing material, the tube 30 is withdrawn from the hole 22. The opening 22 is then closed by tensioning on the loose end 28 of the thread 24. As will be clear to one of skill in the art, as the loose end 28 of the thread 24 is tensioned, the loops in filament 24 interconnecting the two lips 32 and 34 of the opening 22 become smaller thereby drawing the lips of the opening 22 toward one another. As the loose end 28 of the filament 24 is tensioned further, the lips of the opening 22 are brought securely into abutment thereby completely closing the opening 22. This is the condition shown in FIG. 5. The loose end 28 of the filament 24 is then tied off and trimmed so as to be unnoticeable. This can be accomplished in any of a number of ways including tying a small, unnoticeable knot in the filament 28 where it exits the fabric.

Preferably, the filament 24 is chosen to be thick and strong enough to be grasped and pulled by hand without breaking. Depending on the size of the opening 22 and the amount of friction between the fabric and the filament 24, it may be necessary to tighten consecutive loops of the filament across the opening 22 thereby working the opening closed. This is similar to how it is necessary to lace a tall boot starting near the bottom and working upwardly removing slack as you go. It is preferred that the filament have a low friction exterior surface. For example, nylon line or waxed heavy duty thread may be used.

As will be clear to one of skill in the art, the filament 24 may be completely presewn across the hole 22 in any of a number of ways. The illustrated embodiment shows the filament 24 being looped from one side to the other with one end secured and the other free to be pulled. Obviously, the filament could also be sewn in a different pattern or more than one filament could be used so that the opening is "laced" similar to a shoe. Also, the filament could be left free at both ends so that both ends can be pulled tight and tied off.

Figure 5:
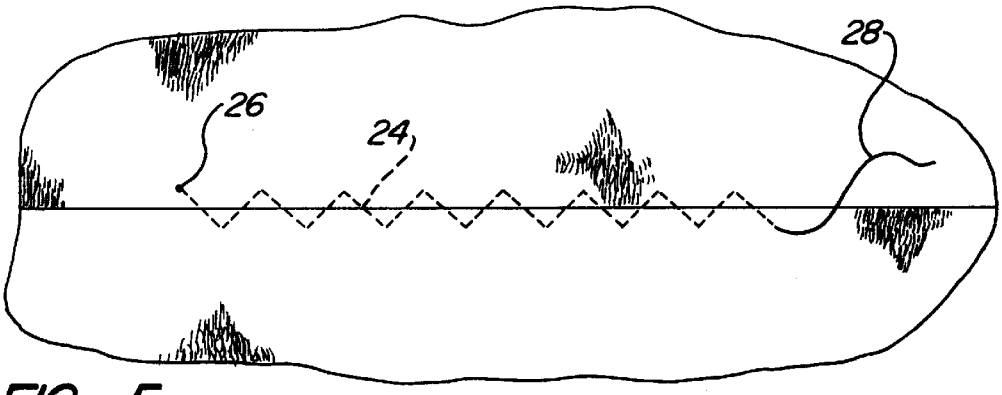
FIG. 5 is a close up view of the finished seam after the stuffing opening of FIG. 3 has been closed according to the method of the present invention.

Because the thread 24 is loosely presewn into the lips of the opening 22, the finished seam, as shown in FIG. 5, gives a better appearance than if the two sides of the opening 22 were bunched up and sewn shut with a sewing machine. The method according to the present invention generally gives a finished seam that is practically invisible. That is, the finished seam appears nearly identical to the other seams joining the fabric skin and does not have a wound-like raw or thick-type scar appearance.

In view of the teaching presented herein, other modifications and variations of the present invention will be readily apparent to those of skill in the art. The foregoing drawings, discussion, and description are illustrative of some embodiments of the present invention, but are not meant to be limitations on the practice thereof.

What is claimed is:

1. A method of making a stuffed toy, comprising the steps of:

a. fastening together a plurality of fabric members so as to define a container which encloses an interior volume and which has an exterior surface defining a shape of the toy, the container further including an opening in communication with said interior volume, said opening having a first and a second lip;

b. providing a length of filament;

c. stitching said filament through said fabric so as to form a plurality of spaced apart loops along the length of the opening, each loop extending from the first lip to the second lip of the opening, said loops being untensioned so as to allow said lips to be separated;

d. providing a stuffing apparatus having an injection tube and means for propelling a stuffing material through said tube;

e. inserting said injection tube into said opening between adjacent loops of said filament;

f. injecting stuffing material into said interior volume of said container through said injection tube;

g. withdrawing said injection tube from said opening;

h. tensioning said filament to tension said loops to draw said lips into abutment, whereby said stuffing is retained in said interior volume.

2. The method of claim 1, wherein said filament has a first end and second end, and the stitching step includes anchoring said first end adjacent said opening and leaving said second end extending outwardly from said exterior surface.

3. The method of claim 2, wherein the tensioning step comprises tensioning said second end of said filament.

4. The method of claim 3, further including the step of tying off said second end of said filament flush with said exterior surface following the tensioning step.

5. The method of claim 1, wherein said spaced apart loops are spaced apart by a distance and sufficiently untensioned so as to allow an injection tube having a diameter of ½ inch to pass between adjacent loops.

6. The method of claim 1, wherein said filament comprises nylon line.

7. The method of claim 1, wherein the stuffing is a chosen from a group consisting of polyester-cellulose fibers, polystyrene beads, polymeric material, shredded textile material, and shredded vegetable material.

* * * * *